US005222403A

United States Patent [19]

Angelini et al.

[11] Patent Number: 5,222,403

[45] Date of Patent: Jun. 29, 1993

[54] DRIVE MECHANISM ENGAGING MEANS FOR GARAGE DOOR OPERATOR

[75] Inventors: Thomas Angelini, Sebring; Terry L. Crock, Massillon, both of Ohio

[73] Assignee: GMI Holdings, Inc., Alliance, Ohio

[21] Appl. No.: 861,463

[22] Filed: Apr. 1, 1992

[51] Int. Cl.[5] ..... E05F 11/54; E05F 15/16; G05G 5/06

[52] U.S. Cl. ..... 74/89.21; 74/110; 74/527; 49/139; 49/199; 160/188; 403/328

[58] Field of Search ..... 74/89.21, 110, 527; 49/139, 199; 160/188; 200/524; 403/324, 328

[56] References Cited

U.S. PATENT DOCUMENTS

| | | | |
|---|---|---|---|
| 2,946,237 | 7/1960 | Hebert | 74/527 |
| 3,051,014 | 8/1962 | Houk | 49/139 X |
| 3,630,094 | 12/1971 | Carli | 49/139 X |
| 3,722,141 | 3/1973 | Miller | 49/139 |
| 3,858,452 | 1/1975 | Gatland et al. | 49/139 X |
| 4,597,428 | 7/1986 | Iha | 160/188 |
| 4,628,636 | 12/1986 | Folger | 49/139 X |
| 4,905,542 | 3/1990 | Burm et al. | 49/139 X |

FOREIGN PATENT DOCUMENTS

| | | | |
|---|---|---|---|
| 1179282 | 3/1960 | Fed. Rep. of Germany | 200/524 |
| 738476 | 10/1955 | United Kingdom | 200/524 |

*Primary Examiner*—Allan D. Herrmann
*Attorney, Agent, or Firm*—Pearne, Gordon, McCoy & Granger

[57] ABSTRACT

A door operator for a reversibly operable door, such as a garage door includes a frame, a motor on the frame, a flexible drive member connected to the motor, and a carriage is mounted for movement along the frame. The carriage moves generally parallel to a portion of the frame and is attached to the door to open and close the door by movement of the carriage along the frame. The carriage can be selectively engaged and disengaged from the flexible drive member using an actuating member extending from the carriage. The carriage and the flexible drive member are engaged and disengaged upon successive motions of the actuating member in a direction substantially perpendicular to the direction of travel of the carriage. The same motion of the actuating member is used to both engage and disengage the mechanism, with successive actions performing the engagement and the disengagement, so that it is not necessary for the user to memorize a complicated engagement or disengagement procedure in order to perform the operation. The mechanism may include a lever bar that provides leverage to the engaging and disengaging action, so that the force applied by the user to the vertically extending actuating member is increased to overcome any resistance resulting from the load on the carriage. The carriage may be adapted for use with an enclosed rail or frame extension and may be comprised of multiple parts that may be disassembled, permitting the carriage to be removed from the frame at any location and eliminating the need for removal of the carriage only through the end of the frame.

19 Claims, 7 Drawing Sheets

78
79
81
80
86
84
83
85
87

119
118
120
98
96
97
98
26
135
133
28
27
160
159
134
7
136
153
167
164
63
65
168
171
177
178
194
129
144
120
119
118
27
7
26

DRIVE MECHANISM ENGAGING MEANS FOR GARAGE DOOR OPERATOR

BACKGROUND OF THE INVENTION

1. Field of the Invention

This invention relates to automatic garage door operators, and more particularly to means for engaging and disengaging the drive mechanism of door operators.

2. Description of the Prior Art

Garage door operators are well known and are commonly used to automatically open and close upwardly acting overhead garage doors. These garage door operators, which are electric motor driven and usually remotely operated by radio control, provide considerable convenience to the motorist for powered, remote opening and closing of the garage door. The operators are usually actuated using a remote transmitting unit, which is typically carried in a vehicle, and is used to signal the controller of the garage door opener system to raise or lower the door, as the driver wishes.

Many different forms have been devised in the prior art to connect the door operator drive mechanisms to the garage door to be moved. Many garage doors are sectional garage doors of the overhead acting type which slide upwardly on a track to a position adjacent the ceiling of the garage. For these doors, the garage door operator includes a frame extending along the garage ceiling which provides a rail for a load carriage that moves longitudinally along the frame. A drive mechanism moves the load carriage, and in my instances, this drive mechanism includes a flexible drive member, and more particularly, a roller chain. The load carriage is pivotally connected to the top section of the sectional garage door. This same construction is also used with slab or one-piece garage doors which are pivoted to swing upwardly adjacent the garage ceiling when in an open position.

Garage door opener systems sometimes become inoperative either due to electrical power outage or, much more infrequently, due to mechanical malfunction. When the garage door opener system becomes electrically inoperative, the drive mechanism remains mechanically connected to the garage door, preventing it from being opened. On these rare occasions the electrically powered garage door operator cannot be used to open the door, so it must be disconnected from the door in order to open the door manually. The door operator thus must provide some means to disengage the door operator from the door so that the door may be manually operated.

A number of releasable connection mechanisms have been proposed for incorporation into the load carriages for selectively disconnecting or mechanically uncoupling the garage door from the drive mechanism. Some prior art release schemes disengaged the door arm pivotal connection and the load carriage. This disengagement permitted the L-shaped door arm to hang downwardly when disconnected from the load carriage and allowed the garage door to be opened and closed. However, these schemes had the very great disadvantage that the door arm, which is an L-shaped member that may be about two feet long and of heavy iron construction, was left pivotally attached to the upper end of the garage door. Thus, when the garage door was manually moved upwardly to an open position, if the user was not extremely cautious, the garage door arm could swing free and puncture a hole in the top of an automobile or in the rear window or windshield of the automobile parked in the garage. Still worse, the door arm could cause physically injury by hitting a person in the head or causing some other sever damage. This was all the more dangerous because electrical power failures only rarely occurred, and the person doing the garage door opening would forget from one time to the next that this potential hazard existed.

In other prior art devices the means to disconnect the garage door from the door operator was very unhandy or very awkward or very difficult to accomplish, was sometimes provided as an afterthought, and in many cases merely consisted of the removal of one of the pivot pins somewhere in the drive train.

A solution to these problems is shown in U.S. Pat. No. 3,630,094 to Carli which shows a selectable disengaging and engaging mechanism for a garage door operator which includes a lock bar that is yieldably urged toward engagement with a chain and which may be longitudinally moved and rotated so that a latch will latch the lock bar in a disengaged condition relative to the chain.

Other release mechanisms are shown in U.S. Pat. No. 3,051,014, issued to Houk, U.S. Pat. No. 3,722,141, issued to Miller, and U.S. Pat. No. 4,905,542, issued to Burm et al.

One problem with most prior art disengaging mechanisms is that they usually required moving an actuating member or handle in a horizontal direction in order to engage or disengage the carriage from the drive chain. Since the garage door operator is mounted to the garage ceiling, it is fairly high, and this horizontal action could be easily accomplished by most people of normal stature. It would be preferable to accomplish the engaging and disengaging action using only a vertical force, but this has heretofore not be possible.

Another problem with most prior art disengaging mechanisms is that the force required by the user to engage and disengage the carriage from the drive chain may be substantial due to the high load forces on the drive chain. The load forces in the direction of travel of the drive chain exceed the force needed to open and close the garage door, and these load forces can create substantial resistance to the engagement and disengagement of the carriage from the drive chain.

SUMMARY OF THE INVENTION

Many of the problems and disadvantages of the prior art have been overcome by the present invention which provides a new mechanism for engaging and disengaging a garage door opener from the garage door in the event that the garage door must be opened and the garage door opener has become inoperative either due to electrical power outage or due to mechanical malfunction. The mechanism of the present invention facilitates the engagement and disengagement of the garage door opener at any time, and permits the engagement and disengagement to be preformed more easily and with less effort than with the prior art.

The present invention provides a mechanism which is operated simply and easily by most users and which reliably provides the engagement and disengagement actions without substantial difficulties.

In accordance with the present invention, the garage door opener may be disengaged or engaged by merely pulling downwardly on a vertically extending actuating member, and this action may be accomplished by pulling on a rope extending down from the carriage. The mechanism of the invention does not require any substantial force in the horizontal direction, which is often difficult to accomplish. Using the mechanism of the present invention, the same downward motion is used to both engage and disengage the mechanism, with successive actions performing the engagement and the disengagement, so that it is not necessary for the user to memorize a complicated engagement or disengagement procedure in order to perform the operation.

The present invention utilizes a camming mechanism that includes a cam follower and a cam path that defines the engaging and disengaging motion of the actuating member and allows the same downwardly pulling actuation by the user to perform both the engaging and the disengaging functions.

The present invention also includes a lever bar that provides leverage to the engaging and disengaging action, so that the force applied by the user to the vertically extending actuating member is increased to overcome any resistance resulting from the load on the carriage.

The engaging means is incorporated into a carriage that is adapted for use with an enclosed rail or frame extension. The carriage moves longitudinally within the enclosed frame and is guided thereby. The carriage is comprised of multiple parts that may be disassembled, permitting the carriage to be removed from the frame at any location and eliminating the need for removal of the carriage only through the end of the frame.

This and other advantages are provided by the present invention of a door operator for a reversibly operable door. The door operator comprises a frame, motor means on the frame, and a flexible drive member connected to the motor means to be driven thereby. A carriage is mounted for movement along the frame. Means are provided for longitudinally guiding movement of the carriage generally parallel to a portion of the frame. Means are also provided for attaching the carriage to the door to open and close the door by movement of the carriage along the frame. Means are provided for selectively engaging and disengaging the carriage and the flexible drive member, whereby engagement of the carriage and the flexible drive member causes the door to open and close as the motor means drives the flexible drive member. The engaging and disengaging means include an actuating member extending therefrom. The carriage and the flexible drive member are engaged and disengaged upon successive motions of the actuating member in a direction substantially perpendicular to the direction of travel of the carriage.

DETAILED DESCRIPTION OF THE PREFERRED EMBODIMENT

Figures 1, 3:
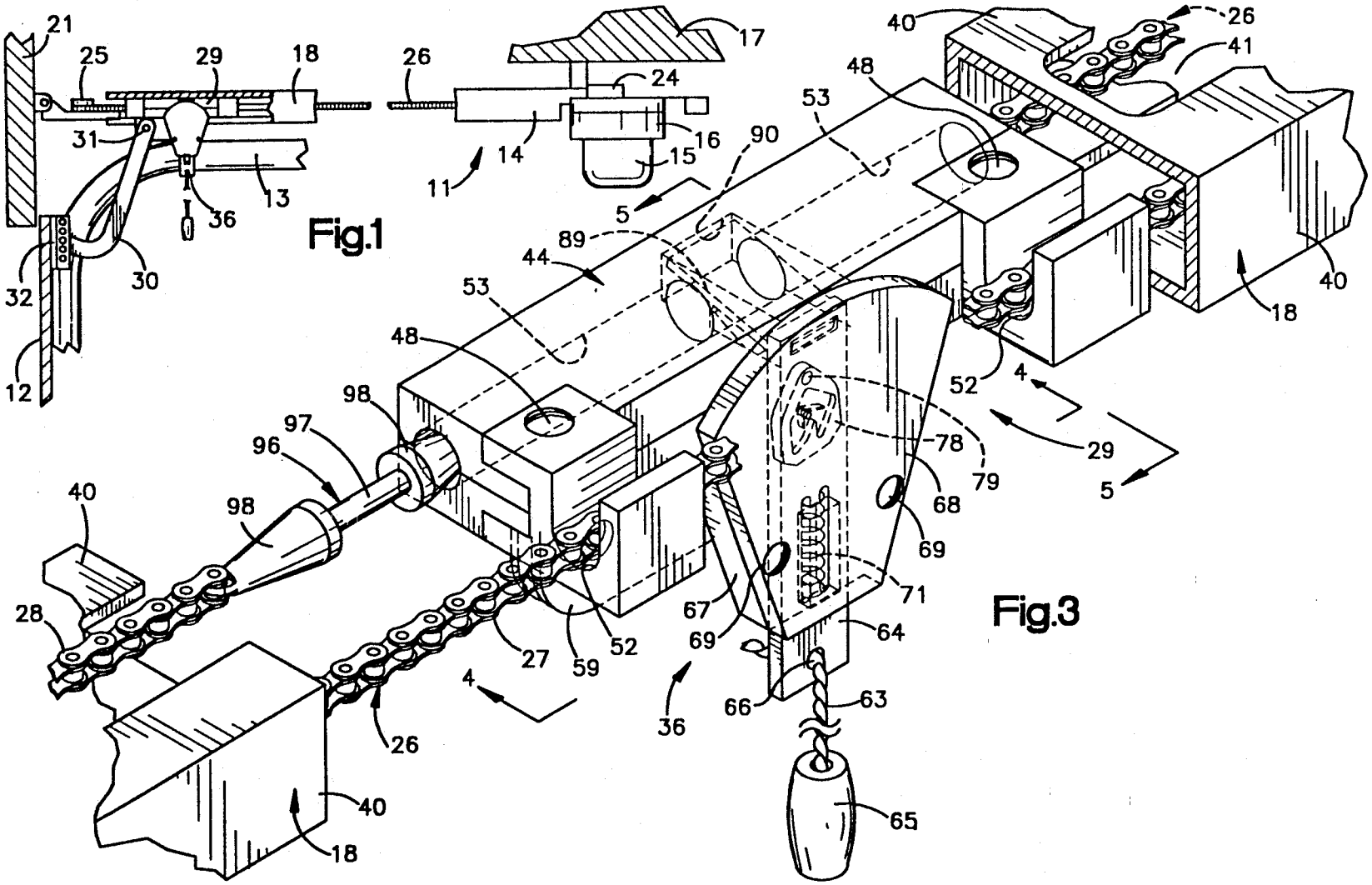
FIG. 1 is a side elevational view of a garage door operator incorporating the present invention.
FIG. 3 is a perspective view showing the elements of FIG. 2 assembled.

Referring more particularly to the drawings, and initially to FIG. 1, there is shown the garage door operator 11 incorporating the present invention. The operator 11 is used to move a garage door 12 or other similar door between opened and closed positions. The garage door 12 may be a one-piece or two-piece door which is pivoted to move to an open position adjacent the garage ceiling, or, as shown, it may be a sectional door rolling upwardly with rollers in a track 13. The garage door operator 11 includes a frame 14 on which an electric motor 15 and a speed-reducing drive train 16 are located. The frame 14 is adapted to be fastened in any suitable manner to the ceiling 17 of the garage. A rail frame extension 18 extends from the frame 14 and is fastened to the header 21 of the garage above the door 12. The frame extension 18 may take the form of an enclosed box-like rail having a rectangular cross section for stiffness and strength as shown in FIGS. 2 and 3.

The drive train 16 has an output or drive sprocket 24 and an idler sprocket or idler roller 25 is provided near the header end of the frame extension 18. A roller chain 26, which is a flexible drive member and in this preferred embodiment is an endless chain, is trained around the drive sprocket 24 and the idler roller 25. As such, the chain 26 has first and second runs 27 and 28 on opposite sides within the frame extension 18. A load carriage 29 is guided for longitudinal sliding movement within the frame extension 18, and is releasably connected to the chain 26. An L-shaped door arm 30 has a pivot connection 31 at one end to the carriage 29 and has a pivot connection 32 at the other end to the top of the door 12. Engaging means 36 is provided to selectively engage and disengage the carriage 29 from the chain 26.

Figure 2:
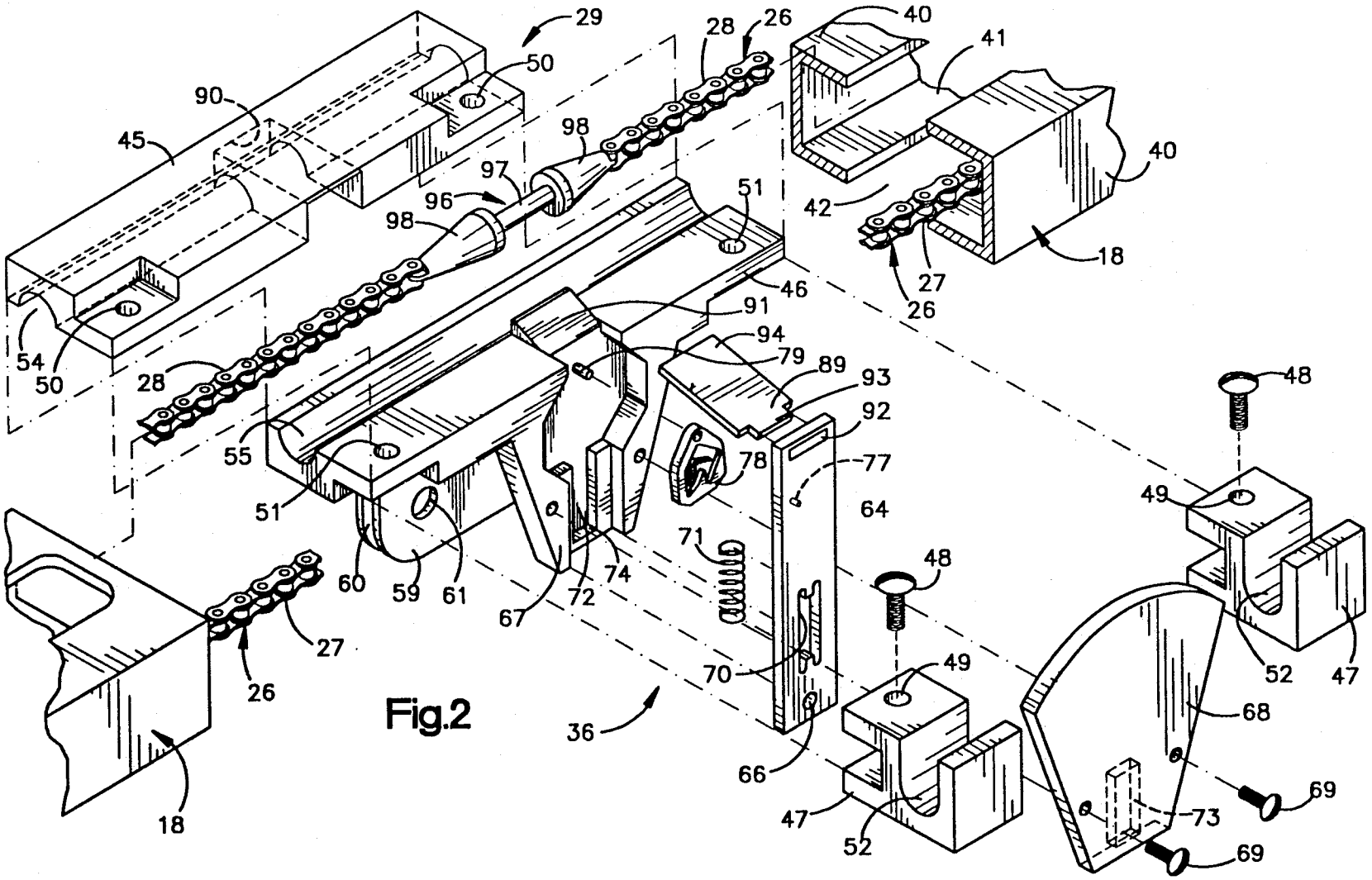
FIG. 2 is an exploded perspective view of a portion of the garage door operator of FIG. 1 showing the carriage and the engaging means.

FIGS. 2 and 3 show the construction and operation of the engaging means 36 in more detail. The frame extension 18 is formed of two opposed C-shaped members 40 which define an interior track for the carriage 29 which is generally rectangular in cross section. The two members 40 are joined together at spaced intervals along the top of the frame extension, leaving open sections 41 in which the carriage 29 may be removed. Along the bottom of the frame extension between the members 40 is a slotted opening 42 through which a portion of the carriage 29 extends to form the pivot connection 31 for the door arm 30. The frame extension members 40 may be of made of steel, and the carriage 29 made of a material which will readily slide longitudinally within the frame extension 18, such as a suitable molded plastic material.

The carriage 29 includes a body 44 (FIG. 3) which is generally rectangular in cross section to fit snugly within the frame extension 18. The carriage body 44 is made of four pieces to permit the body 44 to be disassembled and easily removed from the frame extension 18 through one of the open sections 41. The carriage body 44 comprises an upper carriage body member 45, a lower carriage body member 46 and a pair of connecting members 47 (FIG. 2). The upper carriage body member 45 fits on top of the lower carriage body member 46. The connecting members 47 fit around indentations on the top of the upper carriage body member 45 at each end and corresponding indentations on the bottom of the lower carriage body member 46 at each end. The pieces of the carriage body 44 are secured together by two screws 48, each of which extends through openings 49 in one of the connecting members 47 and through coaxial openings 50 and 51 in the upper and lower carriage body members 45 and 46, respectively. The first run 27 of the chain 26 extends through troughs 52 in the connecting members 47. The second run 28 of the chain 26 is contained within a bore 53 (FIG. 3) extending longitudinally through the carriage body 44. The upper half of the bore 53 is formed by a channel 54 (FIG. 2) in the bottom of the upper carriage body member 45 and a corresponding channel 55 in the top of the lower carriage body member 46.

When it is necessary to remove the carriage 29 from the frame extension, this may be easily accomplished by disassembling the carriage body 44 so that it may be removed through an open section 41 at any location along the frame extension 18. The carriage of this invention is thus much more easily removed that the carriages of the prior art which had to be removed only by moving the carriages beyond the ends of the frame extension. The carriage body 44 of this invention is easily removed from the chain 26 by removal of the screws 48, sliding the connecting members 47 longitudinally from the upper and lower carriage body members, disassembling the upper carriage body member 45 from the lower carriage body member 46, and opening the bore 53 to permit the run 28 of the chain 26 to be removed from the bore 53.

The lower carriage body member 46 includes a flange 59 (FIG. 2) extending downwardly from the bottom of the lower carriage body member 46. The flange 59 includes a central slot 60 into which the top of the door arm 30 is inserted to attach the door arm to the carriage 29. The door arm 30 is secured to the flange 59 by the insertion of a pivot pin through an opening 61 in the flange and through a corresponding opening in the top of the door arm to form the pivot connection 31. The flange 59 and the door arm 30 extend through the slotted opening 42 which extends along the bottom of the frame extension 18.

The carriage 29 is engaged and disengaged from the chain 26 by pulling on an actuating member which in the preferred embodiment may include a chain or rope 63 (FIG. 3) connected to a slide member 64. The rope 63, which has a handle 65 attached to its bottom end, hangs from the carriage 29 and is of sufficient length to permit it to be engaged by a person standing in the garage. The slide member 64 is attached to the top end of the rope 63 through an opening 66 near the bottom of the slide member. The slide member 64 is vertically movable within a cam housing 67 (FIG. 2) formed in the lower carriage body member 46 and is laterally retained within the cam housing by a cover plate 68. The cover plate 68 is attached to the cam housing 67 by a pair of screws 69. The slide member 64 also has a central elongated slot 70 which extends longitudinally along the middle of the slide member. A spring 71 is retained within in the slot 70 with the top of the spring 71 engaging the top of the slot 70, and the bottom of the spring engaging the bottom of the slot. A recess 72 is provided in the cam housing to provide clearance for the spring 71, and a corresponding recess 73 is provided in the cover plate 68 to provide clearance for the spring 71. The bottom of the spring 71 also engages a ledge 74 in the cam housing 67 at the bottom of the recess 72, so that the spring 71 urges the slide member 64 upwardly. When the user pulls on the rope 63, the slide member 64 moves downwardly in opposition to the spring 71. Upon release of the rope 63, the spring 71 urges the slide member 64 upwardly, and the slide member returns to its original position.

The longitudinal movement of the slide member 64 is controlled by a small pin or cam follower 77 (FIG. 2) which extends from one side of the slide member toward the cam housing 67. The cam follower 77 engages a camming member 78 which is mounted on a peg 79 in the cam housing 67. As shown in more detail in FIG. 8, the camming member 78 has a central enlarged recessed portion 80 the edges of which form a portion of the cam path for the cam follower 77. In the middle of the recessed portion 80 is an embossed portion 81 which extends outwardly from the recessed portion and forms more of the cam path. The camming member 78 is mounted On the peg 79 to allow for lateral rocking movement of the camming member as the cam follower 77, which moves only vertically, engages the camming member and follows the cam path.

Figures 6, 8:
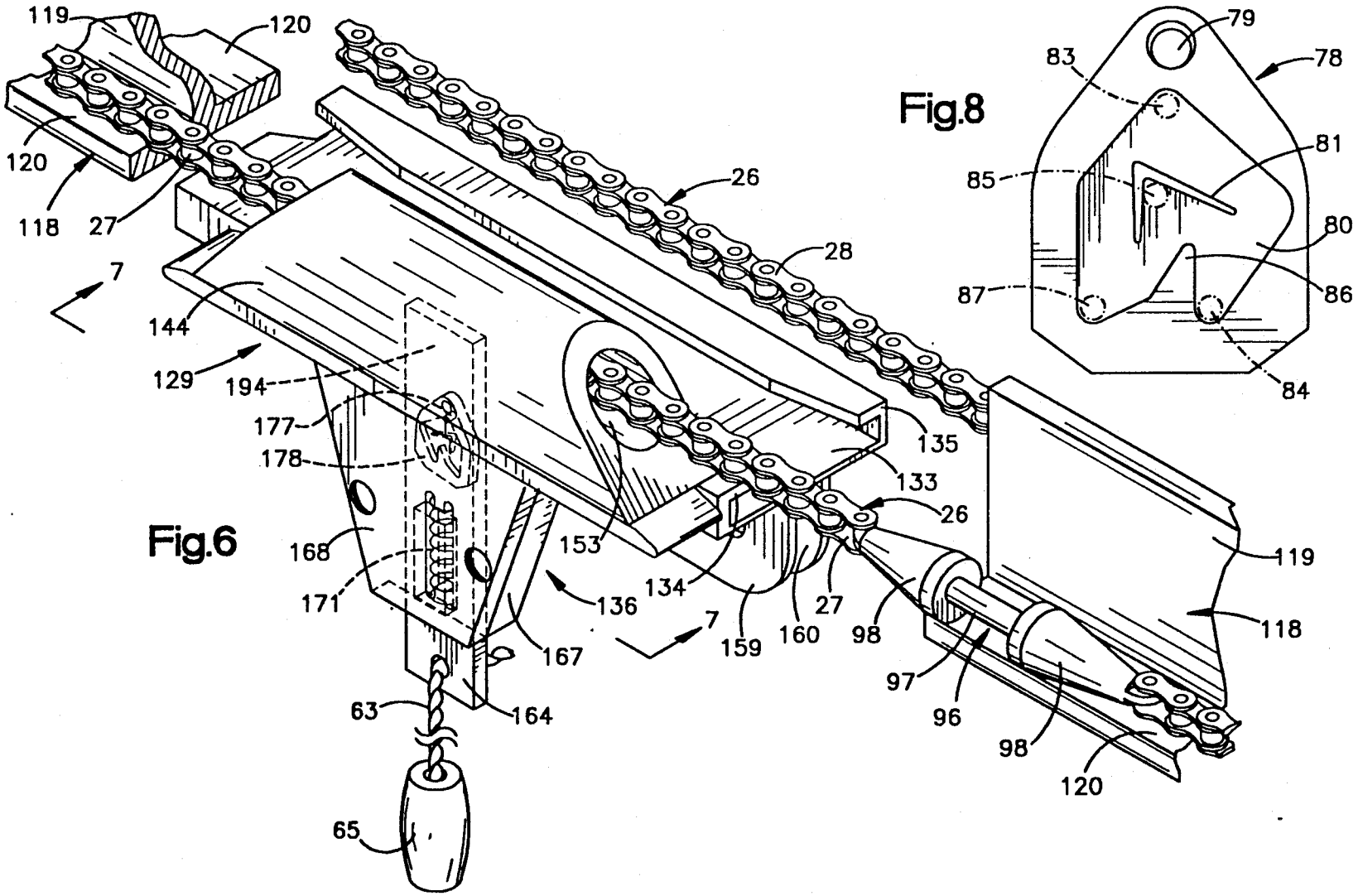
FIG. 6 is a perspective view similar to FIG. 3 showing another embodiment of the present invention.
FIG. 8 is a detailed elevational view of the camming member of FIGS. 1–4 and 6–7 to a larger scale.

The cam path provided on the camming member 78 is shown in more detail in FIG. 8. The cam path includes an engaging position or first position 83 in which the cam follower 77 is located when the carriage 29 is engaged with the chain 26. When the user pulls on the rope 63 and pulls the slide member 64 downwardly, the cam follower 77 moves downwardly from the first position 83 and engages the upper edge of the embossed portion 81. This upper edge of the embossed portion 81 is slanted, so that as the cam follower 77 engages it, it pushes the camming member 78 laterally and causes the camming member to rock on the peg 79. The cam follower 77 follows the upper edge of the embossed portion 81 and is directed to a second position 84 located in the lower right corner of the cam path. The cam follower 77 is located in this second position 84 when the user has pulled down on the rope 63 while the carriage 29 is engaged with the chain 26. Upon release of the rope 63, the slide member 64 and the cam follower 77 move upwardly, and the cam follower is retained by the lower edge of embossed portion 81 and settles into a third position 85. In this third position 85 the slide member 64 is retained against further upward movement, and the carriage 29 is disengaged from the chain 26. When the user pulls downwardly on the rope 63 again, the slide member 64 moves downwardly again. The cam follower 77 moves downwardly but is prevented from returning to the third position 85 by a directing edge 86 of the recessed portion 80. The cam follower 77 is directed to a fourth position 87 in the lower left corner of the cam path. Finally, upon release of the rope 63, the cam follower moves upwardly from the fourth position 87 and returns to the first position 83.

An engaging member in the form of a lever bar 89 extends laterally across the carriage 29 between the upper carriage body member 45 and the lower carriage body member 46 within a cavity 90 formed in the upper carriage body member. The lever bar 89 pivots on a fulcrum 91 formed on the top of the lower carriage body member 46. The slide member 64 has an upper elongated slot 92 extending laterally near the top of the slide member, and one end 93 of a lever bar 89 engages the slot 92. The other end 94 of the lever bar 89 extends into the channel 54 to engage the run 28 of the chain 26 in the bore 53.

The chain 26 is preferably provided with an enlarged coupling 96 which connects the two ends of the chain 26 together to form an endless chain. The coupling 96 has a central reduced diameter portion or recess 97 which is long enough to allow the coupling to be engaged by the end 94 of the lever bar 89. One either side of the recess 97 are enlarged diameter portions 98 which are generally conically shaped to provide a camming incline surface.

The operation of the engaging means 36 can be described with reference to FIGS. 4A through 4D and FIGS. 5A and 5B.

Figure 4A:
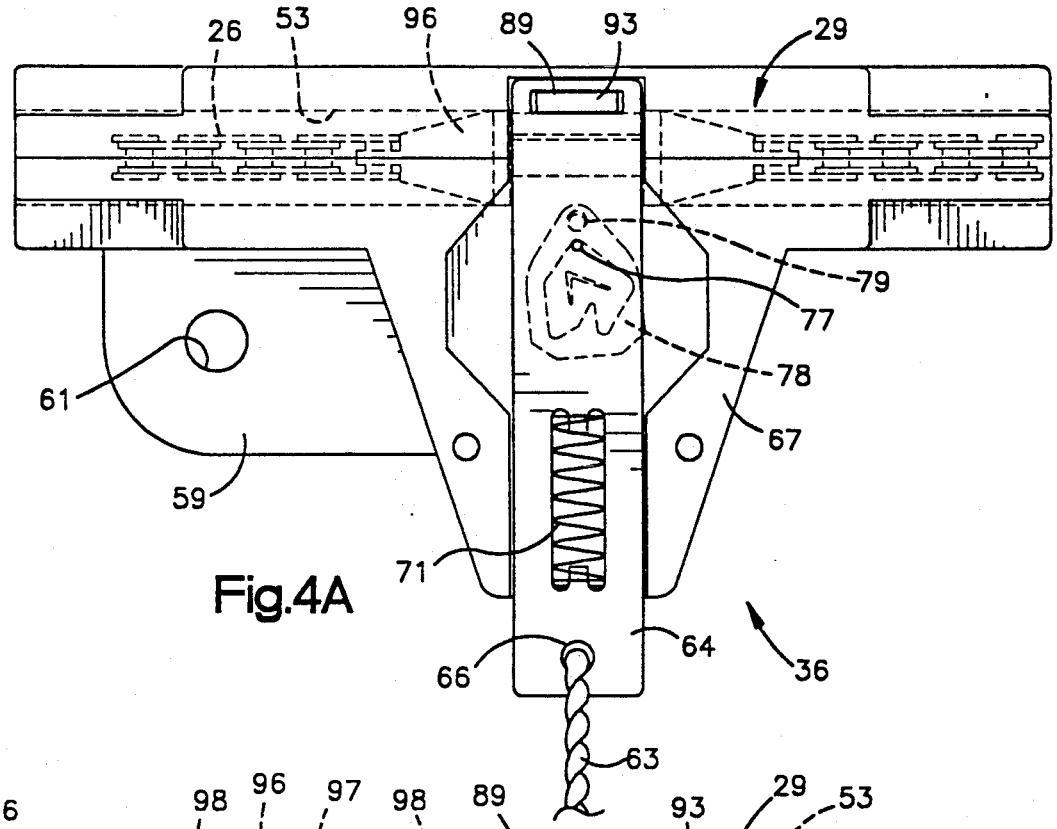
FIGS. 4A–4D are similar side elevational views of the carriage and engaging means showing the operation of the cam means of the engaging means taken along line 4—4 of FIG. 3.
Figure 5B:
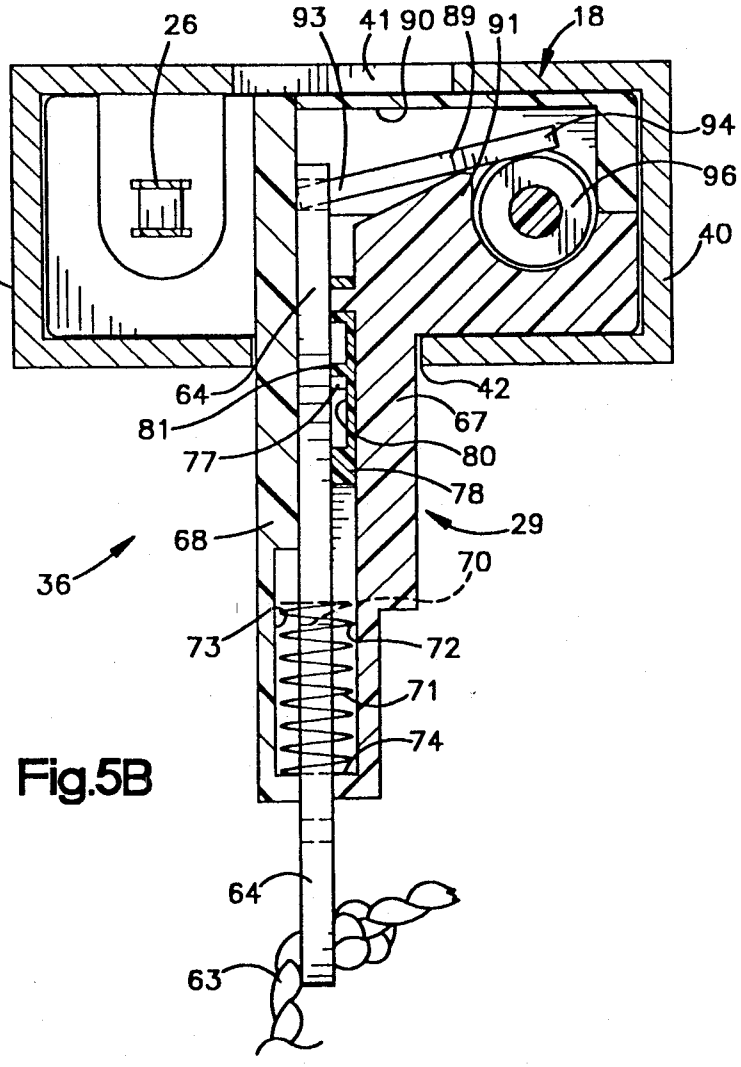
FIGS. 5A and 5B are sectional views showing the operation of the engaging means taken along line 5—5 of FIG. 3.
Figure 5A:
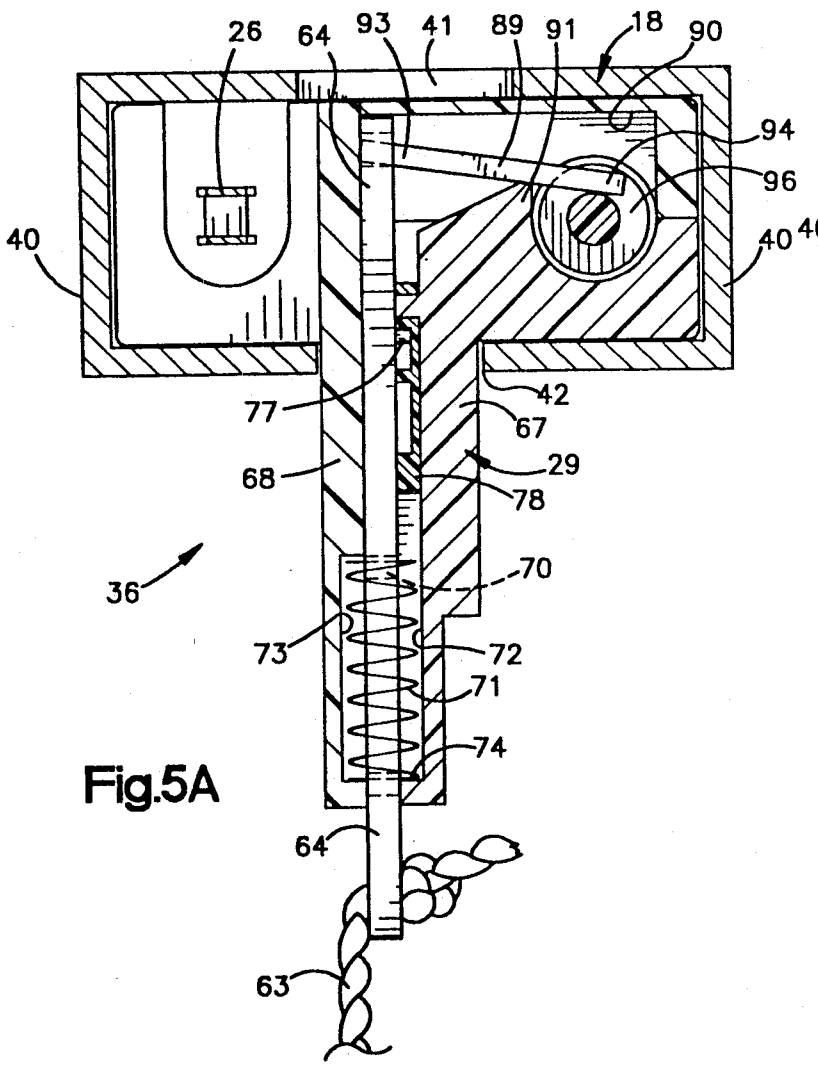

FIGS. 4A and 5A show the normal condition of the engaging means 36 with the carriage 29 locked to the chain 26 so that the garage door operator 11 can open and close the door 12, the end 93 of the lever bar 89 that engages the slide member 64 is in a raised position, so that the other end 94 of the lever bar is in a lowered position engaging the recess 97 of the coupling 96 on the chain 26. The cam follower 77 on the slide member 64 is positioned in the uppermost first position 83 in the cam path on the camming member 78.

Figure 4B:
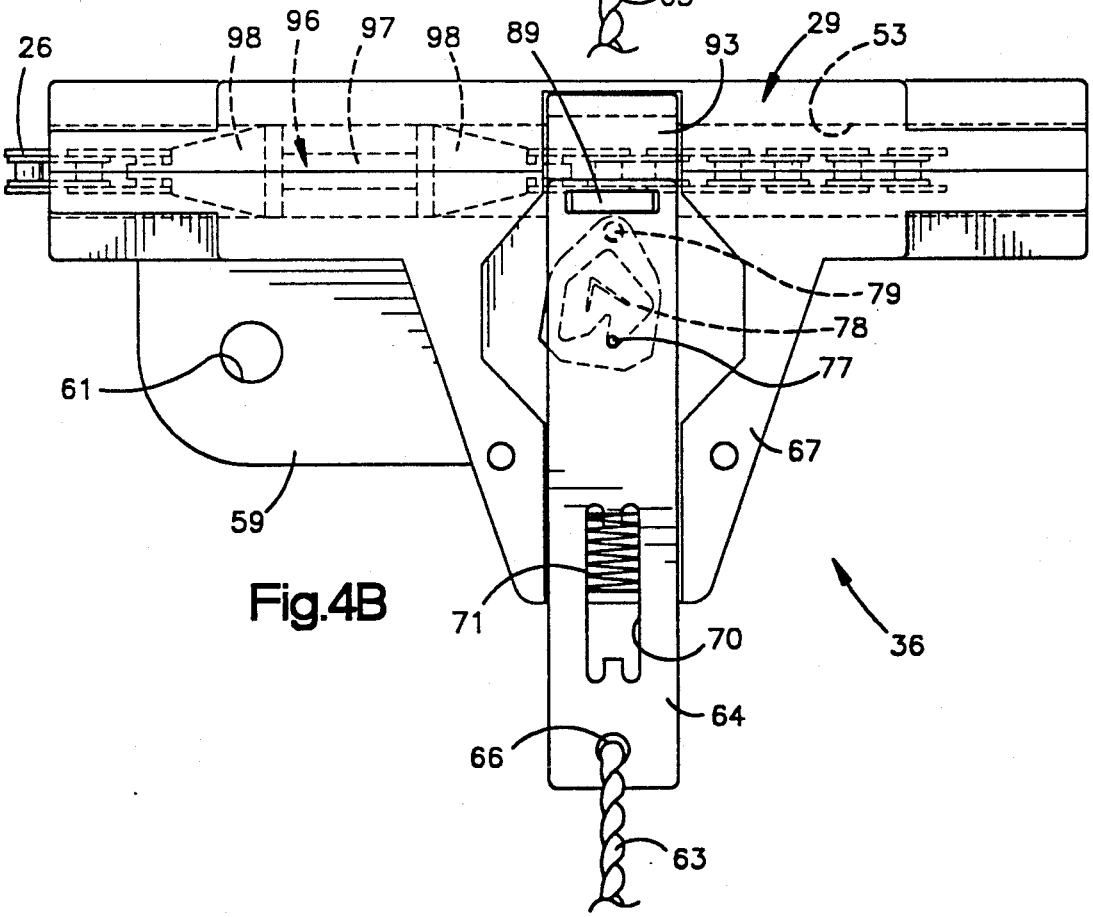

On those rare occasions when the electrical power fails, it is necessary to disengage the garage door operator 11 so that the door 12 may be manually opened or closed. In FIG. 4B, the user has pulled downwardly on the rope 63 to initiate disengagement. The downward force on the rope 63 pulls the slide member 64 downwardly. As the slide member 64 moves downwardly, the spring 71 is compressed between the ledge 74 in the cam housing 67 and the top of the slot 70 in the slide member. The downward movement of the slide member 64 lowers the end 93 of the lever bar 89 and correspondingly raises the other end 94 of the lever bar to lift the lever bar from the bore 53 and remove the lever bar from the recess 97 in the coupling 96 and release the chain 26 from the carriage 29. The cam follower 77 on the slide member 64 has moved to the bottom position 84 of the cam path on the camming member 78 as the cam member rocks on the peg 79 to the left as shown in the FIG. 4B.

Figure 4C:
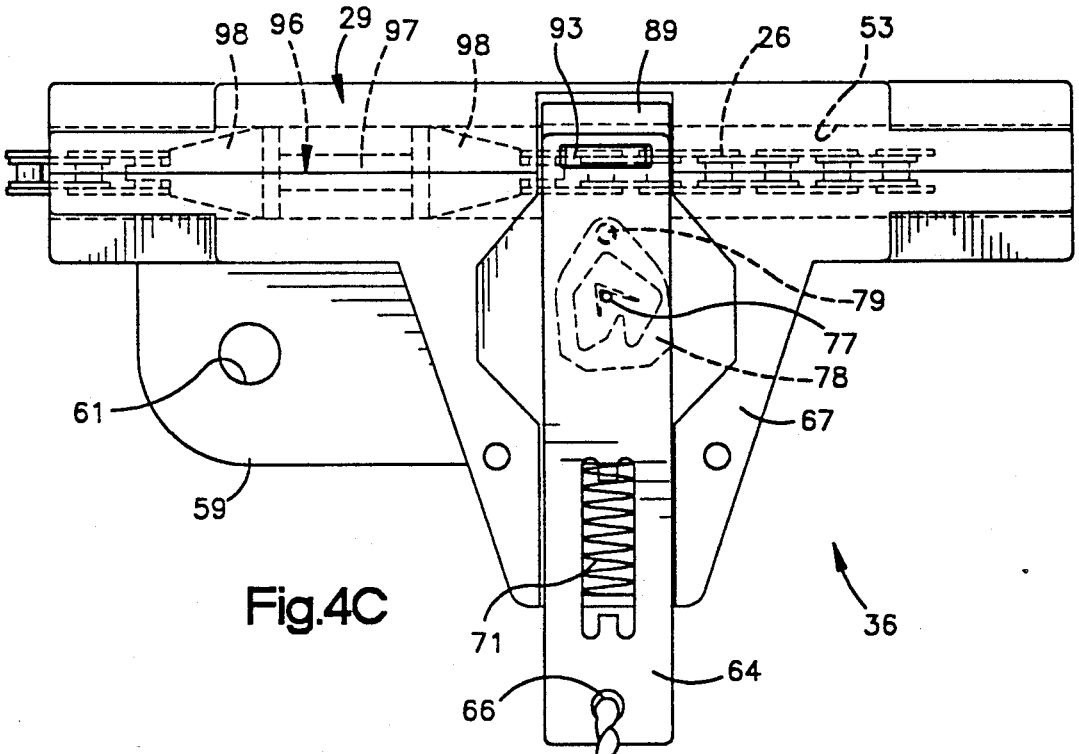

In FIGS. 4C and 5B, the user has released the rope 63 to allow the engaging means 36 to assume its stable disengaged position. The cam follower 77 on the slide member 64 is located in the position 85 engaging the central embossed portion of the cam path on the camming member 78 to hold the slide member downwardly and prevent the slide member from moving fully upwardly as in the engaged position of FIG. 4A. The end 93 of the lever bar 89 that engages the slide member 64 is held downwardly by the slide member, and the other end 94 is held up and removed from the bore 53 and free of the path of the chain 26 and the coupling 96, allowing the chain 26 to move through the bore 53 without contacting the lever bar.

Figure 4D:
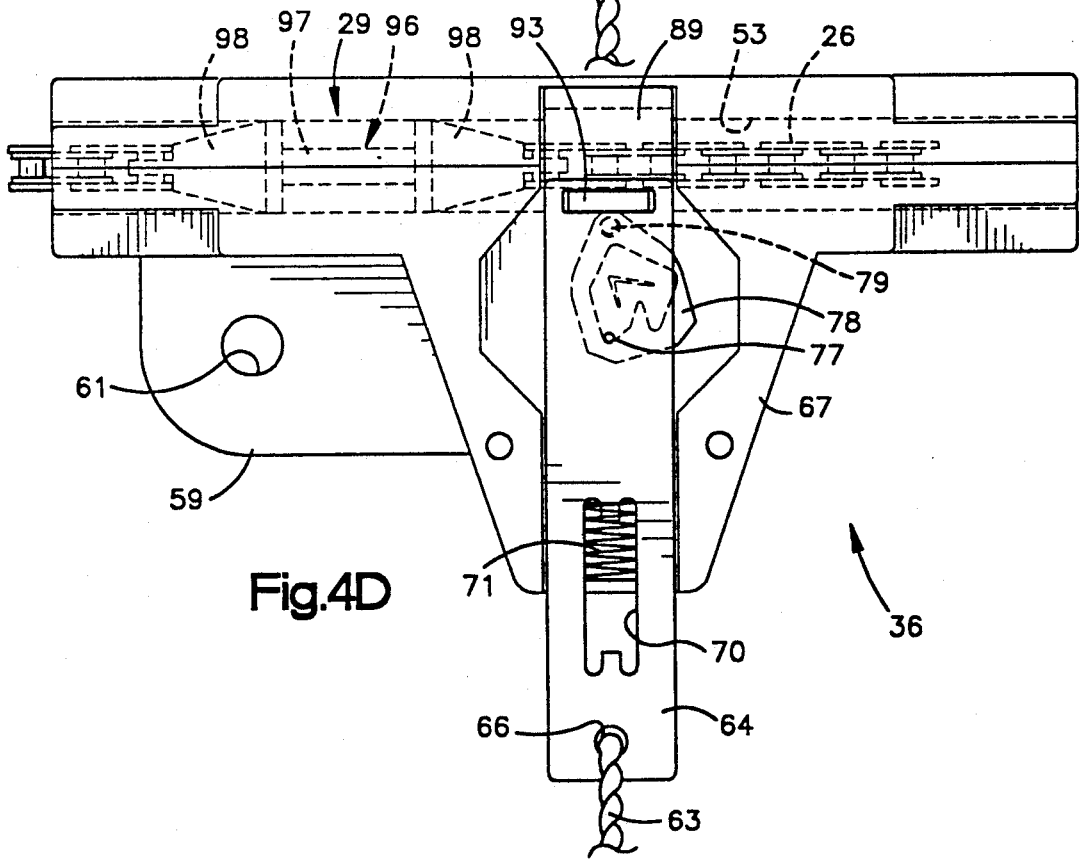

In FIG. 4D, the user has again pulled downwardly on the rope 63 to initiate re-engagement of the carriage 29. The downward force on the rope 63 again moves the slide member 64 downwardly. As the slide member 64 moves downwardly, the spring 71 again is compressed between the top of the slot 70 in the slide member and the ledge 74 in the cam housing 67. The cam follower 77 on the slide member 64 moves downwardly along the cam path on the camming member 78 to the position 87 on the bottom of the cam path as the cam follower rocks to the right as shown in FIG. 4D.

Upon release of the rope 63, the spring 71 moves the slide member 64 upwardly, and the engaging means 36 returns to the position shown in FIGS. 4A and 5A with the end 93 of the lever bar 89 raised and the other end 94 of the lever bar lowered into the bore 53. When the end 94 of the lever bar 89 is returned to this position, the coupling 96 may not be positioned within the bore 53 to be immediately re-engaged by the lever bar 89. The coupling 96, however, can be moved into engagement with the lever bar 89 by actuating the motor 15 to move the chain 26. As the motor 15 moves the chain 26, the coupling 96 will eventually move into the bore 53. The conical portions 98 on each end of the coupling 96 provide ramps which cam the end 94 of the lever bar 89 upwardly and into the recess 97. As the end 94 of the lever bar 89 engages one of the conical portions 98 of the coupling 96, the other end 93 of the lever bar pushes the slide member 64 downwardly in opposition to the spring 71 until the end 94 of the lever bar moves off the conical portion 98 and into the recess 97. The end 94 of the lever bar 89 then moves downwardly into the recess 97 as the other end 93 of the lever bar is pushed upwardly by the spring 71.

As shown in FIGS. 5A and 5B, the fulcrum 91 is positioned closer to the end 94 of the lever bar 89 than to the end 93 of the lever bar. This increases the amount of vertical travel of the slide member 64 required to produce a small vertical movement of the end 94 of the lever bar 89 to engage and disengage from the chain 26. However, this also produces a mechanical advantage through the operation of a simple lever and permits the user to apply added force in disengaging the end 94 of the lever bar 89 from the chain.

While the invention has been described with respect to a rail or frame extension 18 presenting an enclosed rectangular cross-section for the carriage 29, the invention may also be applied to a conventional T-shaped frame extension as shown by another embodiment of the present invention depicted in FIG. 6. A frame extension 118 is in the form of a T-shaped bar with an upright stem 119 and a T-shaped flange 120. One run 27 of the chain 26 extends on one side of the stem 119 and the other run 28 extends on the other side of the stem.

A carriage 129 is mounted on the flange 120 for longitudinal sliding movement. The carriage 129 has a base 133 and two flanges 134 and 135 which extend from the base and which partially wrap around the flange 120 of the frame extension to mount the carriage 129 onto the frame extension 118 while permitting longitudinally guided movement. Attached to one of the flanges 134 is a body 144 having a central bore 153 through which one run 27 of the chain 26 extends. Engaging means 136 is provided to selectively engage and disengage the carriage 129 from the chain 26.

Extending downwardly from the bottom of the base 133 is a flange 159 having a central slot 160 into which the top of the door arm 30 is inserted to attach the door arm to the carriage 129. The door arm 30 is secured to the flange 159 by the insertion of a pivot pin through an opening in the flange and through a corresponding opening in the top of the door arm to form the pivot connection 31.

The carriage 129 is engaged and disengaged from the chain 26 by pulling the actuating member which includes the rope 63 and the lower portion of a slide member 164. The rope 63 has a handle 65 attached to its bottom end, and the top end of the rope 63 is attached to the slide member 164. The slide member 164 is essentially identical to the slide member 64. The slide member 164 is vertically movable within a cam housing 167 formed in the lower portion of the carriage body 144 and is laterally retained within the cam housing by a cover plate 168. A spring 171 is retained within in a central elongated slot in the middle of the slide member. The top of the spring 171 engages the top of the slot in the slide member 164, and the bottom of the spring 171 engages a ledge in the cam housing 167, so that the spring 171 urges the slide member 164 upwardly. When the user pulls on the rope 163, the slide member 164 moves downwardly in opposition to the spring 171. Upon release of the rope 163, the spring 171 urges the slide member 164 upwardly, and the slide member returns to its original position.

The longitudinal movement of the slide member 164 is controlled by a small pin or cam follower 177 which extends from one side of the slide member toward the cam housing 167. The cam follower 177 engages a camming member 178 which is mounted on a peg in the cam housing 167. The camming member 178 is essentially identical to the camming member 78 already described. The upper end 194 of the slide member 164 extends into the bore 153 and forms the engaging member which engages the run 27 of the chain 26 in the bore. The chain 26 includes the coupling 96 which connects the two ends of the chain 26 together to form an endless chain. The coupling 96 has the central reduced diameter portion or recess 97 which is long enough to allow the coupling to be engaged by the upper end 194 of the slide member 164. On either side of the recess 97 are the enlarged diameter portions 98 which are generally conically shaped to provide a camming incline surface.

The operation of the engaging means 136 of FIG. 6 can be described with reference to FIGS. 7A and 7B.

Figure 7A:
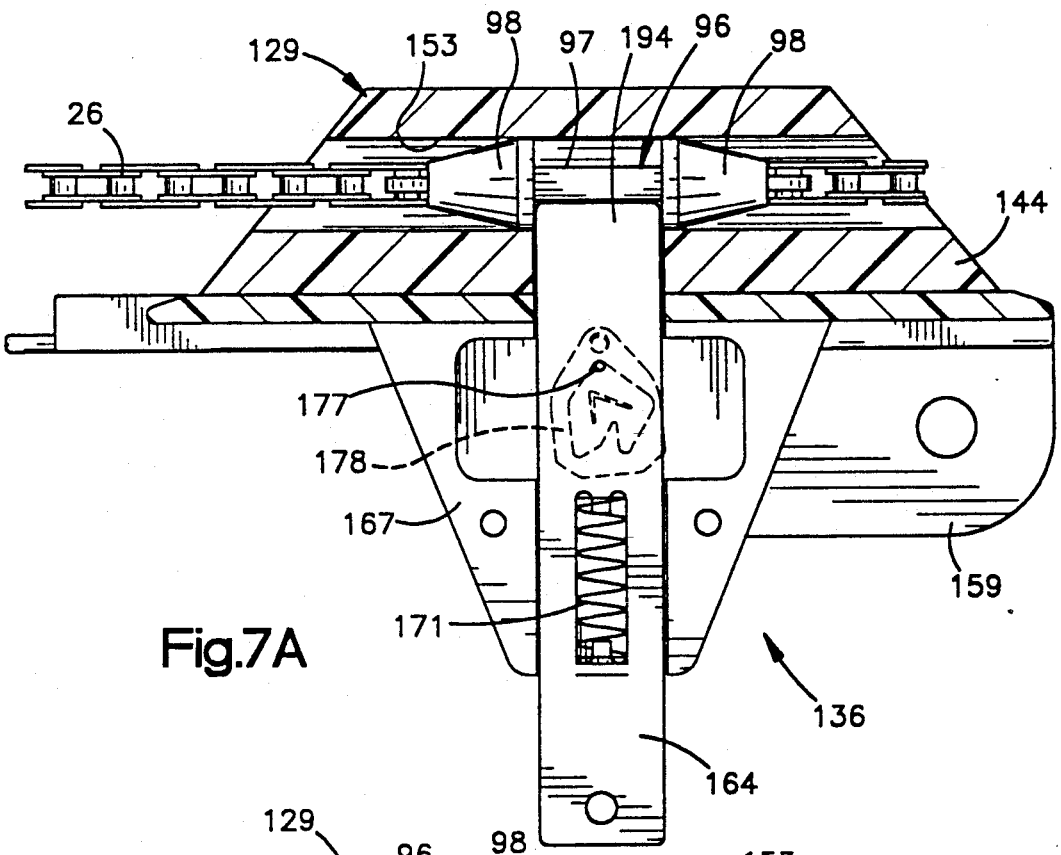
FIGS. 7A and 7B are sectional views showing the operation of the carriage and engaging means taken along line 7—7 of FIG. 6.

FIG. 7A shows the normal condition of the engaging means 136 with the carriage 129 locked to the chain 126 so that the garage door operator 11 can open and close the door 12. The upper end 194 of the slide member 164 is in a raised position, so that it engages the recess 97 of the coupling 96 on the chain 26. The cam follower 177 on the slide member 164 is positioned in the uppermost position travel in the cam path on the camming member 178.

To disengage the garage door operator so that the door 12 may be manually opened or closed, the user pulls downwardly on the rope 63. The downward force on the rope 63 pulls the slide member 164 downwardly. The spring 171 is compressed, and the upper end 194 of the slide member 64 moves downwardly from the bore 153 in the carriage body 144 and remove the slide member from the recess 197 to release the chain 26 from the carriage 129. The cam follower 177 on the slide member 164 moves to the bottom of the cam path on the camming member 178 as the cam member rocks on the peg 179 to the left as shown in the FIGS. 7A and 7B.

Figure 7B:
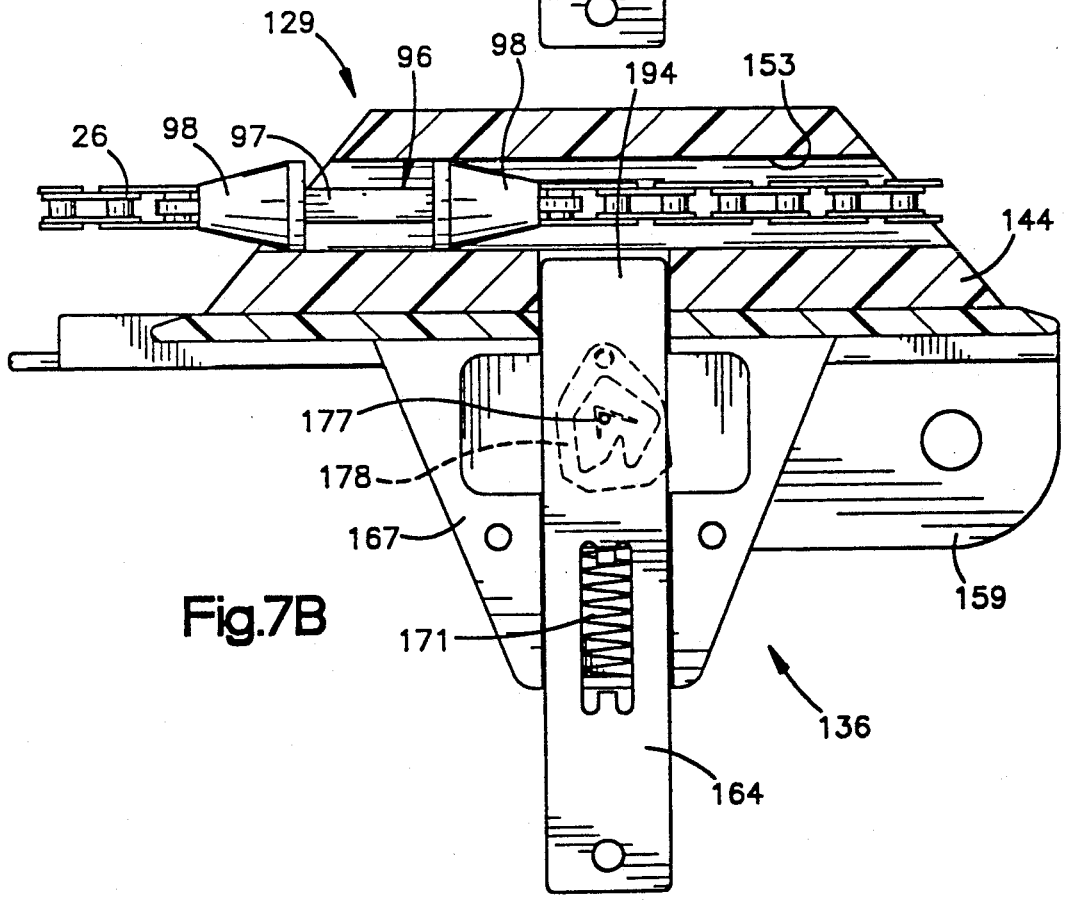

In FIG. 7B, the user has released the rope 63 to allow the engaging means 136 to assume its stable disengaged position. The cam follower 177 on the slide member 164 moves upwardly to engage the central embossed portion of the cam path on the camming member 178 to hold the slide member downwardly and prevent the slide member from moving fully upwardly as in the engaged position of FIG. 7A. The upper end 194 of the slide member 164 is held down, removed from the bore 153 and free of the path of the chain 26 and the coupling 196, allowing the chain 26 to move through the bore 153 without contacting the lever bar.

When the user again pulls downwardly on the rope 63, the downward force on the rope 163 again moves the slide member 164 downwardly, and the spring 171 is compressed. The cam follower 177 on the slide member 164 moves downwardly along the cam path on the camming member 178 to a point on the bottom of the cam path as the cam follower rocks to the right as shown in FIG. 7A and 7B.

Upon release of the rope 63, the spring 171 moves the slide member 164 upwardly, and the engaging means 136 returns to the position shown in FIG. 7A with the upper end 194 of the slide member extending into the bore 153. The coupling 96 may not be positioned within the bore 153 to be immediately re-engaged by the upper end 194 of the slide member 164, but it can be moved into engagement by actuating the motor 15 to move the chain 26. The conical portions 98 on each end of the coupling 96 provide ramps which cam the upper end 194 of the slide member 164 downwardly and into the recess 97. As the upper end 194 of the slide member engages one of the conical portions 98, it pushes the slide member 164 downwardly in opposition to the spring 171 until the upper end 194 of the slide member moves off the conical portion and into the recess 197. The upper end 194 of the slide member then moves upwardly into the recess 197 as the slide member 164 is pushed upwardly by the spring 171.

It can be seen that the engaging means 136 of FIG. 6 operates in essentially the same manner as the engaging means 36 of FIGS. 1-3, except that, since the engaging means 136 of FIG. 6 lacks the lever bar 89, it does not provide the same mechanical advantage as the engaging means 36 of FIGS. 1-3, and the user must exercise additional force to pull the upper end 194 of the slide member 164 out of engagement with the recess 97 of the chain coupling 96.

While the embodiments of the present invention have shown the engaging means in use with a roller chain, the engaging means can be adapted for use with other flexible drive members, such as flexible drive tapes or cables. Furthermore, the principals and essential concepts of the engaging means of the invention may also be used with other drive means such as screw drives.

While the invention has been shown and described with respect to a particular embodiment thereof, this is for the purpose of illustration rather than limitation, and other variations and modifications of the specific embodiment herein shown and described will be apparent to those skilled in the art all within the intended spirit and scope of the invention. Accordingly, the patent is not to be limited in scope and effect to the specific embodiment herein shown and described nor in any other way this is inconsistent with the extent to which the progress in the art has been advance by the invention.

What is claimed is:

1. A door operator for a reversibly operable door, which comprises:

a frame;

motor means on the frame;

a flexible drive member connected to the motor means to be driven thereby;

a carriage mounted for movement along the frame;

means for longitudinally guiding movement of the carriage generally parallel to a portion of the frame;

means for attaching the carriage to the door to open and close the door by movement of the carriage along the frame; and means for selectively engaging and disengaging the carriage and the flexible drive member whereby engagement of the carriage and the flexible drive member causes the door to open and close as the motor means drives the flexible drive member, the engaging and disengaging means including an actuating member extending therefrom, the carriage and the flexible drive member being engaged and disengaged upon successive motions of the actuating member in the same direction, the direction of motion of the actuating member being substantially perpendicular to the direction of travel of the carriage.

2. The door operator as defined in claim 1, wherein the engaging and disengaging means includes an engaging member for selectively engaging the flexible drive member, and cam means for translating the motions of the actuating member into successive engaging and disengaging movements by the engaging member.

3. The door operator as defined in claim 1, wherein the successive motions of the actuating member are in the same direction for engaging and for disengaging the carriage from the flexible drive member.

4. The door operator as defined in claim 1, wherein the flexible drive member includes a chain having links.

5. The door operator as defined in claim 1, wherein the engaging and disengaging means includes a lever member for increasing force applied to the actuating member.

6. The door operator as defined in claim 1, wherein the carriage is capable of being disassembled and removed from the guiding means at locations between ends of the guiding means.

7. A door operator for a reversibly operable door, which comprise a frame;

motor means on the frame;

a flexible drive member connected to the motor means to be driven thereby;

a carriage mounted for movement along the frame;

means for longitudinally guiding movement of the carriage generally parallel to a portion of the frame;

means for attaching the carriage to the door to open and close the door by movement of the carriage along the frame;

means for selectively engaging and disengaging the carriage and the flexible drive member whereby engagement of the carriage and the flexible drive member causes the door to open and close as the motor means drives the flexible drive member, the engaging and disengaging means including an actuating member extending generally downwardly and capable of movement in a direction, an engaging member for selectively engaging the flexible drive member, and cam means for translating the movement of the actuating member into successive engaging and disengaging actions by the engaging member, the cam means including a camming member mounted for rocking movement laterally to the direction of movement of the actuating member.

8. The door operator as defined in claim 7, wherein engaging and disengaging means includes means for engaging and disengaging the carriage and the flexible drive member upon successive motions of the actuating member in a direction substantially perpendicular to the direction of travel of the carriage.

9. The door operator as defined in claim 8, wherein the successive motions of the actuating member are in the same direction for engaging and for disengaging the carriage from the flexible drive member.

10. The door operator as defined in claim 7, wherein the flexible drive member includes a chain having links.

11. The door operator as defined in claim 7, wherein the engaging and disengaging means includes a lever member for increasing force applied to the actuating member.

12. The door operator as defined in claim 7, wherein the carriage is capable of being disassembled and removed from the guiding means at locations between ends of the guiding means.

13. A door operator for a reversibly operable door, which comprises:

a frame;

motor means on the frame;

a flexible drive member connected to the motor means to be driven thereby;

a carriage mounted for movement along the frame; means for longitudinally guiding movement of the carriage generally parallel to a portion of the frame, the carriage capable of being disassembled and removed from the guiding means at locations between ends of the guiding means;

means for attaching the carriage to the door to open and close the door by movement of the carriage along the frame; and means for selectively engaging and disengaging the carriage and the flexible drive member whereby engagement of the carriage and the flexible drive member causes the door to open and close as the motor means drives the flexible drive member.

14. A door operator as defined in claim 13, wherein the engaging and disengaging means includes an actuating member extending therefrom, the carriage and the flexible drive member being engaged and disengaged upon successive motions of the actuating member in a direction substantially perpendicular to the direction of travel of the carriage.

15. The door operator as defined in claim 14, wherein the engaging and disengaging means includes an engaging member for selectively engaging the flexible drive member, and cam means for translating the motions of the actuating member into successive engaging and disengaging movements by the engaging

16. The door operator as defined in claim 15, wherein the successive motions of the actuating member are in the same direction for engaging and for disengaging the carriage from the flexible drive member.

17. The door operator as defined in claim 13, wherein the flexible drive member includes a chain having links.

18. The door operator as defined in claim 13, wherein the engaging and disengaging means includes an actuating member extending therefrom and a lever member for increasing force applied to the actuating member.

19. A door operator for a reversibly operable door, which comprises:

a frame;

motor means on the frame;

a flexible drive member including a chain having links connected to the motor means to be driven thereby;

a carriage mounted for movement along the frame;

means for longitudinally guiding movement of the carriage generally parallel to a portion of the frame, the carriage capable of being disassembled and removed from the guiding means at locations between ends of the guiding means;

means for attaching the carriage to the door to open and close the door by movement of the carriage along the frame; and means for selectively engaging and disengaging the carriage and the flexible drive member whereby engagement of the carriage and the flexible drive member causes the door to open and close as the motor means drives the flexible drive member, the engaging and disengaging means including an actuating member extending generally downwardly, a lever member for increasing force applied to the actuating member an engaging member for selectively engaging the flexible drive member, and cam means for translating the motions of the actuating member into successive engaging and disengaging movements by the engaging member, the carriage and the flexible drive member being engaged and disengaged upon successive motions of the actuating member in a direction substantially perpendicular to the direction of travel of the carriage, the successive motions of the actuating member being in the same direction for engaging and for disengaging the carriage from the flexible drive member.

* * * * *